US006048185A

United States Patent [19]

Ishizuka et al.

[11] Patent Number: 6,048,185

[45] Date of Patent: Apr. 11, 2000

[54] HYDRAULIC PUMPS

[75] Inventors: Atsushi Ishizuka; Mitsuhiro Aota, both of Kanagawa, Japan

[73] Assignee: Unisia Jecs Corporation, Atsugi, Japan

[21] Appl. No.: 09/095,598

[22] Filed: Jun. 11, 1998

[30] Foreign Application Priority Data

Jun. 24, 1997 [JP] Japan ..... 9-181872

[51] Int. Cl.[7] ..... F01C 21/04

[52] U.S. Cl. ..... 418/102

[58] Field of Search ..... 418/102; 384/276, 384/295

[56] References Cited

U.S. PATENT DOCUMENTS 5,503,478 4/1996 Blaine ..... 384/100

FOREIGN PATENT DOCUMENTS 7-279871 10/1995 Japan .

*Primary Examiner*—Edward K. Look
*Assistant Examiner*—Thomas E. Lazo
*Attorney, Agent, or Firm*—Foley & Lardner

[57] ABSTRACT

A hydraulic pump includes a pump body having a bearing hole and formed with a seal chamber at an end of the bearing hole and an oil groove therein, the oil groove ensuring hydraulic communication between the pump unit and the seal chamber, a pump cover attached to the pump body to define a concavity for accommodating a pump unit, and a drive shaft arranged through the bearing hole of the pump body. A bearing bush, which is arranged through the bearing hole of the pump body to support the drive shaft, includes bush lugs disposed in the axial direction of the bearing hole of the pump body. Two of the bush lugs disposed at both ends of the bearing bush have seams located circumferentially distant from each other.

5 Claims, 3 Drawing Sheets

HYDRAULIC PUMPS

BACKGROUND OF THE INVENTION

The present invention relates to hydraulic pumps which serves as a power source for use, e.g. in power steering devices for motor vehicles.

One of the hydraulic pumps of this type is disclosed, e.g. in JP-A 7-279871. This hydraulic pump comprises a pump unit arranged between a pump body and a pump cover, and a drive shaft supported by a bearing bush arranged through a bearing hole of the pump body to drive the pump unit. A seal chamber is arranged at an end of the bearing hole.

The bearing bush, which is obtained by rounding a plate, has at the inner periphery a spiral oil groove which open to both ends, through which hydraulic oil leaking from the pump unit is led into the seal chamber.

With this known hydraulic pump, the pump unit is driven by the drive shaft supported by the bearing bush, i.e. through a pulley mounted to an end of the drive shaft which protrudes from the pump body, and a belt wound on the pulley, obtaining the pump function.

With driving of the pump unit, leakage oil is produced from the pump unit, which is led from the bearing hole into the oil groove. Hydraulic oil in the oil groove of the bearing bush fulfills lubrication between the bearing bush and the drive shaft, then flows into the seal chamber. Lubrication between the bearing bush and the drive shaft is ensured by a predetermined clearance arranged between the bearing bush and the drive shaft. Lubricating oil is supplied from the oil groove to the clearance, which forms an oil film with rotation of the drive shaft to support the drive shaft, avoiding direct contact of the drive shaft with the bearing bush.

When the drive shaft drives the pump unit, the drive shaft is supported by the bearing bush through the predetermined clearance arranged between the two, and thus it can be inclined in the cylindrical bearing bush. As a consequence, the bearing bush comes in contact with the drive shaft with greater pressure at both ends, but with smaller pressure substantially in the center portion as viewed in the longitudinal direction. It is thus understood that with lubrication between the bearing bush and the drive shaft, stable formation of an oil film is necessary at both ends of the bearing bush than substantially in the center portion thereof.

With the known hydraulic pump, however, if the bearing bush obtained by rounding a plate has a seam corresponding to a portion with which the drive shaft comes in contact with greater pressure, the seam interrupts formation of an oil film, which may cause poor lubrication, particularly, at both ends of the bearing bush. Moreover, due to the fact that the bearing bush has at the inner periphery an oil groove formed overall as viewed in the longitudinal direction, through which hydraulic oil lubricates the inner surface of the bearing bush then flows into the seal chamber, the oil groove also interrupts formation of an oil film, which may cause poor lubrication at both ends of the bearing bush.

Specifically, when the drive shaft rotates, lubricating oil is drawn in a wedgelike way into the clearance formed between the drive shaft and the bearing bush to be narrower in the direction of rotation, which produces an oil-film pressure to achieve formation of an oil film. However, existence of a seam and an oil groove of the bearing bush prevents achievement of a sufficient oil wedge action, making stable formation of an oil film difficult, resulting in possible poor lubrication.

It is, therefore, an object of the present invention to provide hydraulic pumps which are free from poor lubrication between the drive shaft and the bearing bush.

SUMMARY OF THE INVENTION

An aspect of the present invention lies in providing a hydraulic pump, comprising:

a pump unit;

a body with a hole, said body being formed with a seal chamber at an end of said hole and a groove in said hole, said groove ensuring hydraulic communication between said pump unit and said seal chamber;

a cover attached to said body to define a concavity for accommodating said pump unit;

a drive shaft arranged through said hole of said body; and a bush arranged through said hole of said body to support said drive shaft, said bush including portions disposed in an axial direction of said hole of said body, two of said portions disposed at both ends of said bush having seams located circumferentially distant from each other.

DETAILED DESCRIPTION OF THE INVENTION

Figure 1:
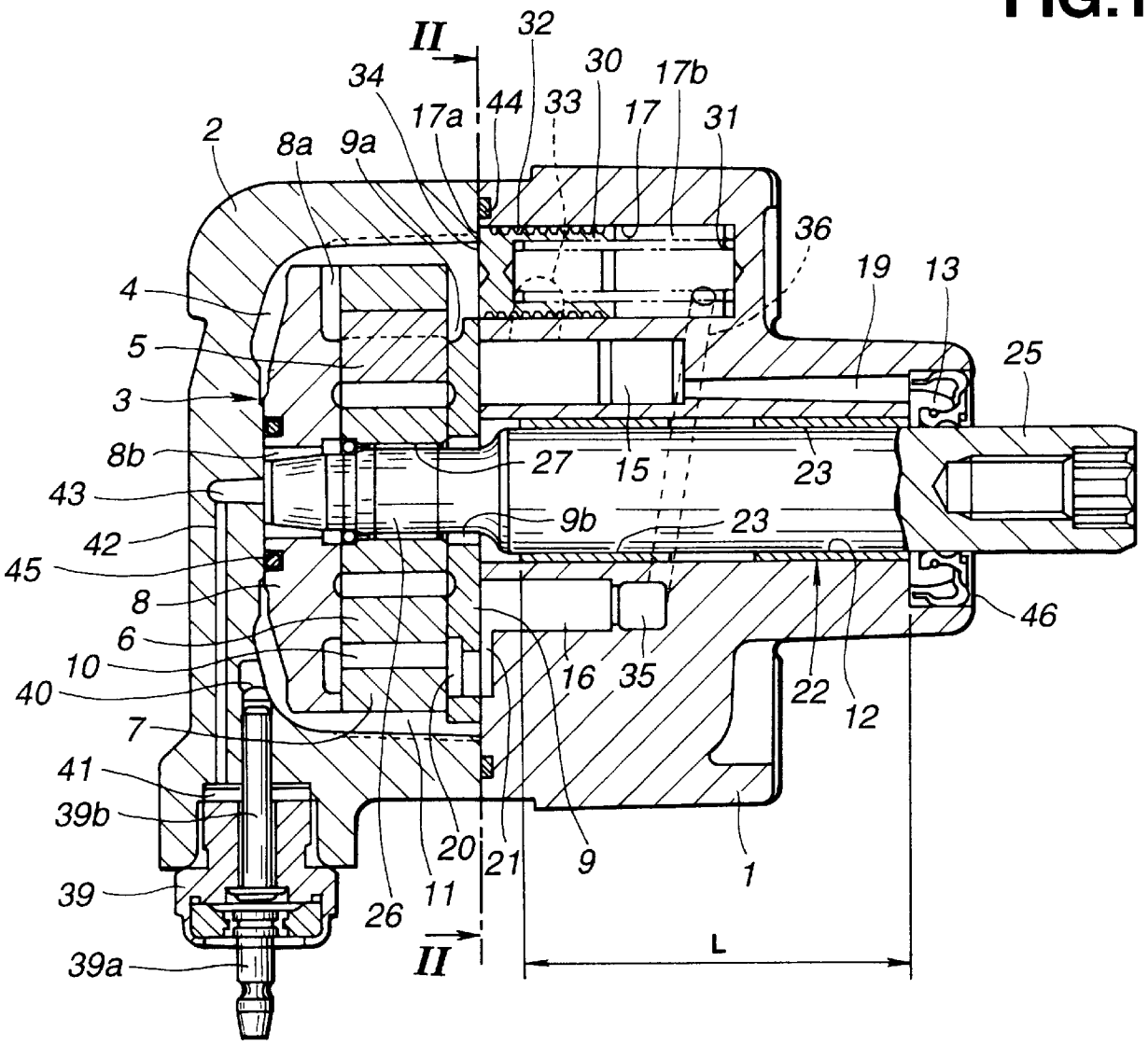
FIG. 1 is a longitudinal section showing a hydraulic pump embodying the present invention.

Referring to the drawings, a hydraulic pump embodying the present invention is applied to a power steering device. Referring to FIG. 1, the hydraulic pump including a vane pump, a plunger pump, a piston pump, etc. comprises a pump body 1 made of a metallic material such as aluminum alloy, a pump cover 2 attached to the pump body 1 and made of the metallic material, and a pump unit 3 arranged between the two. Specifically, the pump body 1 and the pump cover 2 cooperate to define an annular concavity 4 for accommodating the pump unit 3.

The pump unit 3 includes a vane pump unit which comprises a rotor 6 having vanes 5 mounted radially protrudably, a cam ring 7 for accommodating the rotor 7, and side plates 8, 9 for holding both sides of the cam ring 7. A pump chamber 10 is defined between the cam ring 7, the rotor 6, and adjacent vanes 5. The volume of the pump chamber 10 is varied with rotation of the rotor 6, which forms a suction section in the volume increasing portion and a discharge section in the volume decreasing portion. The side plates 8, 9 which face the discharge section are formed with recess passages 8*a*, 9*a* which open radially outwardly so that pump discharge oil is discharged into a discharge chamber or high-pressure chamber 11 of the annular concavity 4 of the cam ring 7. The side plate 9 which faces the suction section is formed with a suction port, not shown.

Figure 2:
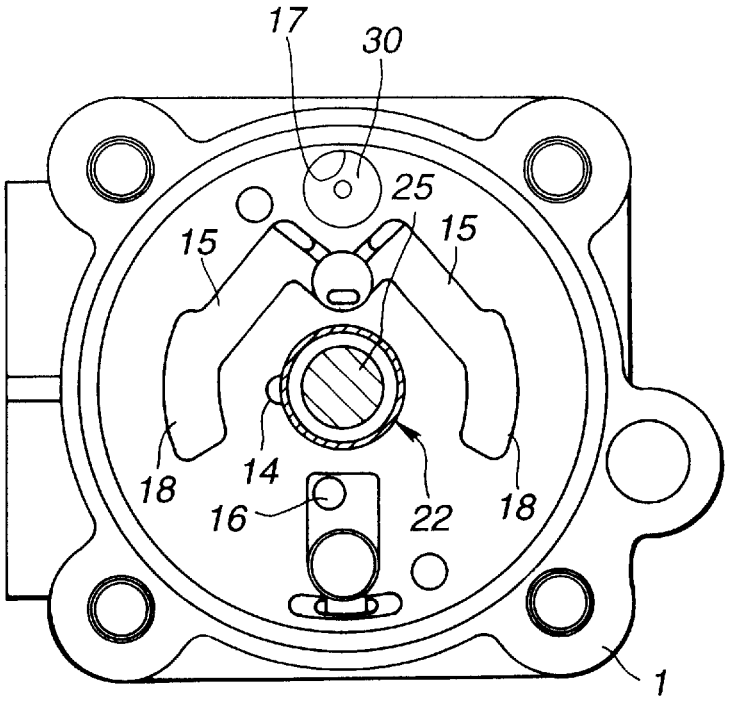
FIG. 2 is a cross section taken along the line II—II in FIG. 1.
Figure 4:
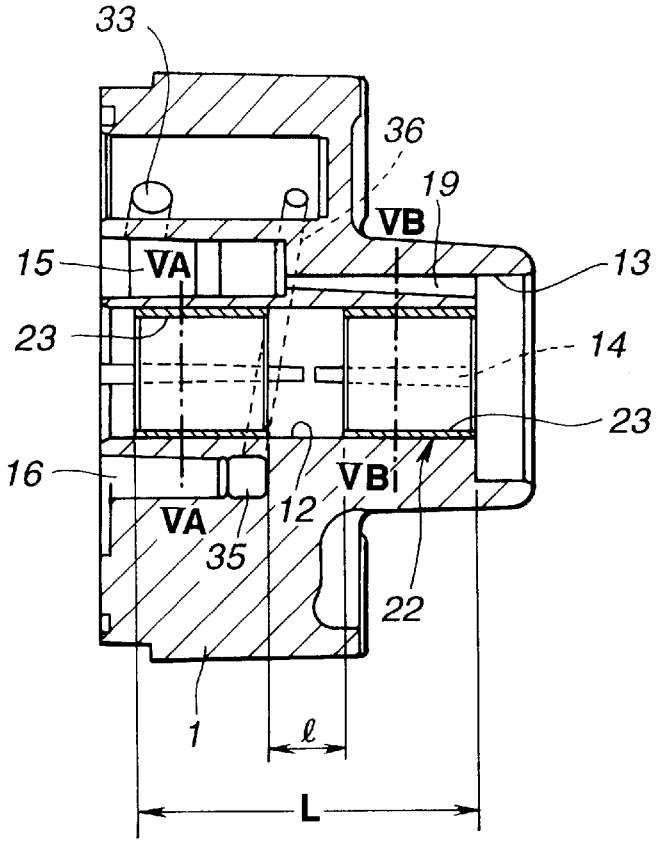
FIG. 4 is a view similar to FIG. 1, showing a pump body with the bearing bush arranged through a bearing hole.

A bearing hole 12 is formed through the pump body 1, and a seal chamber 13 is formed at an end thereof. Referring to FIGS. 2 and 4, an oil groove 14 is formed in the bearing hole 12 to ensure communication between the pump unit 3 and the seal chamber 13. The oil groove 14 has a circular section, and extends substantially straightly as viewed in the axial direction of the bearing hole 12. In the embodiment, the oil groove 14 is discontinued substantially in the center of the bearing hole 12 as viewed in the axial direction thereof. However, due to the fact that this discontinued position is located between bush lugs as will be described later, the two portions of the oil groove 14 are substantially continued through a clearance between the bush lugs. Thus, the oil groove 14 can lead leakage oil from the pump unit 3, i.e. hydraulic oil leaked through a clearance between the rotor 6 and the side plates 8, 9 and hydraulic oil leaked through a seam between the pump body 1 and the side plate 9, from the bearing chamber 12 of the pump unit 3 to the seal chamber 13.

The pump body 1 is formed with a suction passage 15 for ensuring communication between the pump chamber 10 in the suction section and an oil storage tank, not shown, a discharge passage 16 for ensuring communication between the pump chamber 10 in the discharge section and an actuator of the power steering device, not shown, and a spool-valve hole 17 having one end closed.

As shown in FIG. 2, the suction passage 15 is branched into two portions at the seam between the pump body 1 and the side plate 9, each having an end formed with a circular suction port 18. The suction port 18 faces a suction port of the side plate 9, not shown. Moreover, the suction passage 15 communicates with the seal chamber 13 through a low-pressure passage 19 arranged substantially parallel to the bearing hole 12.

The discharge passage 16 is bent radially outwardly at the seam between the pump body 1 and the side plate 9, and is formed with an orifice passage 21 which communicates with a discharge port 20 of the side plate 9.

Figure 3:
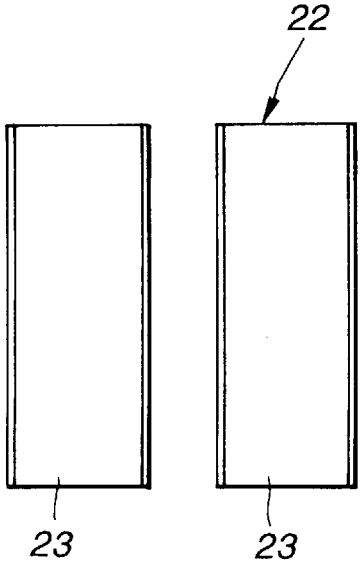
FIG. 3 is a development showing a bearing bush.

As shown in FIG. 4, a bearing bush 22 is arranged in the bearing hole 12. The bearing bush 22 comprises bush lugs 23 disposed at predetermined intervals as viewed in the axial direction of the bearing hole 12. In the embodiment, two bush lugs 23 are disposed axially with an interval 1. Referring to FIG. 3, the bush lug 23 is obtained by rounding a plate, and the bearing bush 22 is smoothly formed at the inner periphery without any recess such as an oil groove.

Figure 5A:
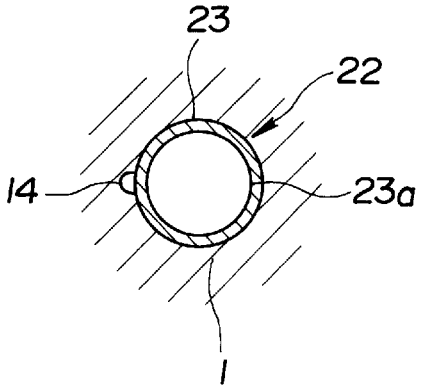
FIG. 5A is a view similar to FIG. 2, taken along the line VA—VA in FIG. 4.
Figure 5B:
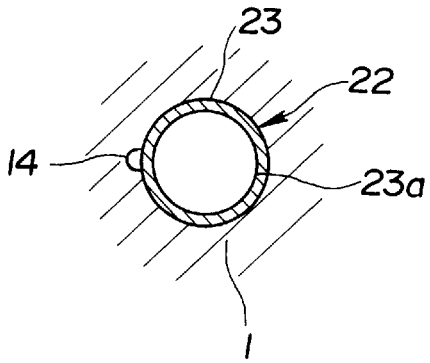
FIG. 5B is a view similar to FIG. SA, taken along the line VB—VB in FIG. 4.

Referring to FIGS. 4–5B, seams 23*a* of the bush lugs 23 at both ends of the bearing bush 22 are positioned circumferentially distant from each other. In the embodiment, the seams are positioned substantially 180° distant from each other. Specifically, the seam 23*a* of the left bush lug 23 as shown in FIG. 5A is located substantially 180° distant from the oil groove 14, whereas the seam 23*a* of the right bush lug 23 as shown in FIG. 5B is located to correspond to the oil groove 14.

Referring to FIGS. 2 and 4, the interval 1 of the bush lugs 23 constituting the bearing bush 22 is, preferably, substantially ⅓ an axial length L of the bearing bush 22 to secure the bearing area. In the embodiment, the interval 1 is substantially ⅕ the axial length L of the bearing bush 22.

A drive shaft 25 for driving the pump unit 3 is arranged through the bearing hole 12 in the state supported by the bearing bush 22. The drive shaft 25 has an end formed with a serration 26 which is arranged through a through hole 9*b* of the side plate 9 and is engaged with a serration hole 27. Thus, the drive shaft 25 can drive the rotor 6, i.e. the pump unit 3. The end of the drive shaft 25 is tapered and loosely engaged with a through hole 8*b* of the side plate 8.

A spool valve 30 for controlling the flow rate is slidably arranged in the spool-valve hole 17 to define therein first and second pressure chambers 17*a*, 17*b*. The spool valve 30 is always biased to the first pressure chamber 17*a* by a spring force of a control spring 31 accommodated in the second pressure chamber 17*b*. In the normal state, a land 32 of the spool valve 30 closes a drain passage 33 which communicates with the suction passage 15. An open end of the first pressure chamber 17*a* defined by the spool valve 30 faces the discharge chamber 11 to form a passage 34 for leading pump discharge oil.

The pump body 1 is formed with a passage 35 which communicates with a discharge port, not shown, to communicate with the discharge passage 16 so as to lead hydraulic oil to the power steering device or the actuator. The passage 35 and the second pressure chamber 17*b* communicate with each other through a passage 36 to lead a pressure within the discharge passage 16 into the second pressure chamber 17*b*.

A pressure switch 39 is mounted to the pump cover 2. The pressure switch 39 has a stationary and movable contacts 39*a*, 39*b*, and is responsive to a pressure within the discharge chamber 11 by an end of the movable contact 39*b* facing a passage 40 which communicates with the discharge chamber 11. The pressure switch 39 is fixedly mounted in a concavity 41 which communicates with the through hole 9*b* of the side plate 9 through a radial passage 42 and an axial passage 43.

The pump body 1 and the pump cover 2 are connected to each other by bolts, etc. not shown. A seam between the pump body 1 and the pump cover 2 is sealed by a seal ring 44 to prevent hydraulic oil discharged into the discharge chamber 11 from leaking outside.

A seal ring 45 is arranged between the pump cover 2 and the side plate 8 to define the discharge chamber 11 and the through hole 8*b* of the side plate 8. Moreover, a seal member 46 is arranged in the seal chamber 13 to seal the drive shaft 25.

Driving means such as a pulley, which is driven by an internal combustion engine, etc., not shown, is arranged at an end of the drive shaft 25 protruding from the pump body 1.

With such a structure, the drive shaft 25 is driven by the driving means such as a pulley, which drives the rotor 6 connected thereto. With rotation of the rotor 6, hydraulic oil is sucked from the suction passage 15 into the suction section of the pump chamber 10 having an increasing volume, and is discharged, after being subjected to a pump action, from the discharge section of the pump chamber 10 having a decreasing volume into the discharge chamber 11. Hydraulic oil discharged in the discharge chamber 11 is led into the first pressure chamber 17*a* through the passage 34. Hydraulic oil led in the first pressure chamber 17*a* is led to the actuator of the power steering device through the orifice passage 21, the discharge passage 16, and the passage 35.

At that time, in the normal state as shown in FIG. 1, the spool valve 30 is biased to the first pressure chamber 17*a* by the control spring 31. Thus, the land 32 of the spool valve 30 closes the drain passage 33, so that the entirety of pump discharge oil introduced in the first pressure chamber 17*a* is led to the actuator through the orifice passage 21. On the other hand, when the pump rotating speed becomes greater to increase the quantity of pump discharge oil introduced in the first pressure chamber 17*a*, hydraulic oil in the first pressure chamber 17*a* is led to the discharge passage 16 with flow restricted by the orifice passage 21. Moreover, in accordance with a differential pressure between the upstream and downstream sides of the orifice passage 21, the spool valve 30 is moved rightwardly to press the control spring 31 up to a predetermined length, which opens the drain passage 33 to circulate surplus oil from the drain passage 33 to the suction passage 15 and the oil storage tank.

Thus, hydraulic oil led to the power steering device through the discharge passage 16 and the passage 35 is controlled to have a predetermined flow rate.

With driving of the pump unit 3, hydraulic oil is discharged into the discharge chamber 11, and is leaked through the clearance formed between the rotor 6 and the side plates 8, 9 for lubrication. A very small part of hydraulic oil is leaked also through the seam between the pump body 1 and the side plate 9.

Leakage oil from the pump unit 3 is collected once in the bearing hole 12 on the side of the pump unit 3. Specifically, leakage oil between the rotor 6 and the side plate 8 is led into the through hole 8*b* of the side plate 8, then collected in the bearing hole 12 through a clearance between the serrations 26, 27 and the through hole 9*b* of the side plate 9. Moreover, leakage oil between the rotor 6 and the side plate 9 is collected in the bearing hole 12 through the through hole 9*b* of the side plate 9.

Hydraulic oil collected in the bearing hole 12 on the side of the side plate 9 lubricates the bearing hole 12, then flows into the seal chamber 13 through the oil groove 14 formed in the bearing hole 12. Hydraulic oil introduced in the seal chamber 13 lubricates the seal member 46 of the seal chamber 13, then circulates to the suction passage 15 and the oil storage tank through the low-pressure passage 19.

At that time, leakage oil derived from the pump unit 3 and introduced in the bearing hole 12 is supplied from the bearing hole 12 on the pump unit 3 to the inner surface of the bearing bush 22 directly, and from the seal chamber 13 to the inner surface of the bearing bush 22. Moreover, a part of leakage oil introduced in the oil groove 14 is supplied from the oil groove 14 to the clearance between the adjacent bush lugs 23, then from the clearance between the bush lugs 23 to the inner surface of the bearing bush 22.

Specifically, leakage oil from the pump unit 3 is supplied from the bearing hole 12 on the side of the pump unit 3 to the inner surface of the bush lugs 23 disposed on the side of the pump unit 3 directly, and from the seal chamber 13 to the inner surface of the bush lugs 23 disposed on the side of the seal chamber 13. Moreover, a part of leakage oil introduced in the oil groove 14 is supplied from the oil groove 14 to the clearance between the adjacent bush lugs 23, then from the clearance between the bush lugs 23 to the inner surface of each bush lug 23. That is, hydraulic oil supplied to the clearance between the bush lugs 23 is supplied to the inner surfaces of the bush lugs 23 disposed on the side of the pump unit 3 and on the side of the seal chamber 13.

With rotation of the drive shaft 25, hydraulic oil supplied to the inner surface of the bearing bush 22 is drawn in a wedgelike way into the clearance formed between the drive shaft 25 and the bearing bush 22 to be narrower in the direction of rotation, which produces an oil-film pressure to achieve excellent formation of an oil film.

When the drive shaft 25 drives the pump unit 3, the drive shaft 25 is supported by the bearing bush 22 through the predetermined clearance arranged between the two, and thus it can be inclined in the cylindrical bearing bush 22. Therefore, the bearing bush 22 comes in contact with the drive shaft 25 with greater pressure at both ends. However, in the embodiment, stable formation of an oil film is secured at both ends of the bearing bush 22, preventing poor lubrication effectively.

Specifically, since the bearing bush 22 comprises bush lugs 23 disposed with the predetermined interval 1 as viewed in the axial direction of the bearing hole 12, the clearance or interval 1 is formed substantially in the center of the bearing bush 22 as viewed in the axial direction thereof. However, the bush lugs 23 are disposed at both ends of the bearing bush 22 with which the drive shaft 25 come in contact with greater pressure, and have at the inner periphery no oil groove which interrupts formation of an oil film.

Moreover, the seams 23*a* of the bush lugs 23 constituting the bearing bush 22 are positioned circumferentially distant from each other. If the seam 23*a* of one bush lug 23 is located distant from the portion with which the drive shaft 25 comes in contact with greater pressure, the seam 23*a* of another bush lug 23 is also located distant from the portion with which the drive shaft 25 comes in contact with greater pressure. As a consequence, the seams 23*a* of the bush lugs 23 which interrupt formation of an oil film fail to correspond to the portion of the bearing bush 22 with which the drive shaft 25 comes in contact with greater pressure.

Moreover, lubricating oil is sufficiently supplied to the inner surface of the bearing bush 22 comprising the bush lugs 23 not only from both ends of the bearing bush 22, but from the clearance between the adjacent bush lugs 23. As a consequence, stable formation of an oil film is ensured, particularly, at both ends of the bearing bush 22 with which the drive shaft 25 comes in contact with greater pressure, preventing poor lubrication.

Therefore, a hydraulic pump is obtained which produces no poor lubrication by stable formation of an oil film between the drive shaft 25 and the bearing bush 22.

Having described the present invention with regard to the preferred embodiment, it is noted that the present invention is not limited thereto, and various changes and modifications can be made without departing from the scope of the present invention.

By way of example, the oil groove 14 formed in the bearing hole 12 may be spiral in place of being substantially axially straight, or include plurality of groove portions.

Moreover, when the bearing bush 22 includes three or more bush lugs 23, the bush lugs 23 may be disposed at regular or irregular intervals.

What is claimed is:

1. A hydraulic pump, comprising:

a pump unit;

a body with a hole, said body being formed with a seal chamber at an end of said hole and a groove in said hole, said groove ensuring hydraulic communication between said pump unit and said seal chamber;

a cover attached to said body to define a concavity for accommodating said pump unit;

a drive shaft arranged through said hole of said body; and a bush arranged through said hole of said body to support said drive shaft, said bush including portions disposed in an axial direction of said hole of said body, two of said portions disposed at both ends of said bush having seams located circumferentially distant from each other.

2. A hydraulic pump as claimed in claim 1, wherein each of said portions of said bush is formed by rounding a plate.

3. A hydraulic pump as claimed in claim 1, wherein said portions of said bush are disposed at regular intervals.

4. A hydraulic pump as claimed in claim 3, wherein each of said regular intervals is substantially ⅓ an axial length of said bush.

5. A hydraulic pump as claimed in claim 1, wherein said portions of said bush are disposed at irregular intervals.

* * * * *

UNITED STATES PATENT AND TRADEMARK OFFICE

CERTIFICATE OF CORRECTION

PATENT NO. : 6,048,185
DATED : April 11, 2000
INVENTOR(S) : Ishizuka et al.

It is certified that error appears in the above-identified patent and that said Letters Patent is hereby corrected as shown below:

Column 6,
Line 54, after "claim 1," insert -- having at least three bush portions, --.
Line 55, after "portions" delete -- of said bush --.
Line 58, after "claim 1," insert -- having at least three bush portions, --.
Line 59, after "portions" delete -- of said bush --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*